US006721514B2

(12) United States Patent
Kida

(10) Patent No.: US 6,721,514 B2
(45) Date of Patent: Apr. 13, 2004

(54) IMAGE FORMING APPARATUS

(75) Inventor: Hiorshi Kida, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 26 days.

(21) Appl. No.: 09/959,850

(22) PCT Filed: Mar. 9, 2001

(86) PCT No.: PCT/JP01/01876

§ 371 (c)(1),
(2), (4) Date: Jan. 28, 2002

(87) PCT Pub. No.: WO01/67184

PCT Pub. Date: Sep. 13, 2001

(65) Prior Publication Data

US 2002/0159778 A1 Oct. 31, 2002

(30) Foreign Application Priority Data

Mar. 10, 2000 (JP) ..... 2000-067575

(51) Int. Cl.[7] ..... G03G 15/00

(52) U.S. Cl. ..... 399/12; 222/DIG. 1; 399/262; 399/44

(58) Field of Search ..... 399/12, 24, 31, 399/33, 38, 44, 67, 262; 222/DIG. 1

(56) References Cited

FOREIGN PATENT DOCUMENTS

| | | |
|---|---|---|
| EP | 0 789 322 A | 8/1997 |
| JP | A1-150170 | 6/1989 |
| JP | A7-64438 | 3/1995 |
| JP | 2704139 B2 | 10/1997 |
| JP | A10-282741 | 10/1998 |
| JP | 11-223967 A | 8/1999 |
| JP | A11-327368 | 11/1999 |
| JP | A2000-235286 | 8/2000 |
| JP | A2000-235318 | 8/2000 |

*Primary Examiner*—Hoang Ngo
(74) *Attorney, Agent, or Firm*—Birch, Stewart, Kolasch & Birch, LLP

(57) ABSTRACT

When a developer supply unit is mounted to the predetermined position of a machine base, a detector disposed on the machine side extracts information managed by a management portion of the unit. Based on this management information, the decision portion of the controller determines the characteristics of the developer supply unit to decide the operating conditions of each unit portion. At the same time, the operational environment under which the machine will be installed is decided based on the determined result.

11 Claims, 6 Drawing Sheets

IMAGE FORMING APPARATUS

This application is the national phase under 35 U.S.C. §371 of PCT International Application No. PCT/JP01/01876 which has an International filing date of Mar. 9, 2001, which designated the United States of America.

DESCRIPTION

1. Technical Field

The present invention relates to an image forming apparatus which enables image forming by mounting part of the constituents for the process of recording images.

2. Background Art

In the field of image forming apparatus such as copiers, printers, etc., products which are enabled to record images by mounting a process unit, developer cartridge or the like have been conventionally developed and put on the market. Image forming apparatus of this type are improved in service performance such as simplifying exchange of consumed parts to be used for image forming such as consumable supplies, reducing machine suspension time due to usage items reaching the end of their life, reducing time for replacement of parts and simplifying parts replacement tasks.

One example of a cartridge for accommodating such usage items has been disclosed in Registered Patent No. 2704139. This is a cartridge configuration for replacement of consumable electrophotographic process components. In order to achieve the image forming process conditions suitable for the characteristics of the photosensitive member provided in this cartridge, the cartridge incorporates as a part thereof an information source which represents the characteristics of the photosensitive member. This information source is detected by the image forming apparatus so as to set up appropriate image forming conditions.

However, this image forming apparatus does not take into account the environment under which the machine is installed and operated. Accordingly, on the part of the machine-supplying manufacturer, it is necessary to prepare and store not only the cartridge parts but also various machine bases suitable for and demanded by the market of different environments (countries, areas, etc.) under which the machine is installed. Therefore, it is necessary to prepare various kinds of products ranging from cartridge to machine base, posing a distribution cost problem.

Thus, it is necessary to prepare a variety of products partially different in specifications, due to the differences in their destination, sales routes or the like. Taking developer cartridges of a shape for storing developer as an example, various developer cartridges different in the amount and characteristics of the developer held therein are prepared depending upon their destinations and sales routes.

Further, as to the machine bases onto which the developer cartridge is mounted, multiple specs of machines conforming to a maintenance system (various user maintenance specifications, various serviceperson maintenance specifications) suitable for the stored amount of developer of each developer cartridge are prepared, in accordance with their destinations and sales routes. Therefore, developer cartridges adapted to destinations and sales routes and various machine bases having different operating programs, for example, corresponding to different cartridges should be kept in stock.

It is therefore an object of the present invention to provide an image forming apparatus which, based on the information obtained from a usage item mounted to the image forming machine base, determines the operational environment under which the machine is installed, and which is operated in accordance with the operational environment thus determined.

DISCLOSURE OF INVENTION

In order to achieve the above object, the present invention is configured as follows:

The first aspect of the present invention resides in an image forming apparatus for forming images on recording media, comprising: a container of a constituent or consumable item to be used for image forming, including the constituent or consumable item and being removably attached to the machine base; and a controller for controlling the operations of various parts in the apparatus including the container, characterized in that the container has a management portion for managing the information as to the constituent or consumable item contained therein and the controller determines an operational environment under which the apparatus will be installed, based on the information, and sets operating conditions of the various parts of the apparatus.

The second aspect of the present invention resides in the image forming apparatus having the above first aspect, further comprising: a detector for detecting a condition of the constituent or consumable item, wherein the controller, based on the information, monitors the condition of the constituent or consumable item by the detector.

The third aspect of the present invention resides in the image forming apparatus having the above first or second aspect, wherein the controller checks if each part in the apparatus is capable of operating within the operational environment at a determined installed location.

The fourth aspect of the present invention resides in the image forming apparatus having any one of the above first through third aspect s, wherein the constituent or consumable item is a fixing unit, and the information managed by the management portion is information as to fixing conditions of the fixing unit.

The fifth aspect of the present invention resides in the image forming apparatus having any one of the above first through third aspect s, wherein the determined operational environment of the apparatus is a destination where the apparatus will be installed.

The sixth aspect of the present invention resides in the image forming apparatus having any one of the above first through third aspect s, wherein the determined operational environment of the apparatus is a language to be displayed on a display portion of the apparatus.

The seventh aspect of the present invention resides in the image forming apparatus having any one of the above first through third aspects, wherein the determined operational environment of the apparatus is power supply voltage to be supplied to the apparatus.

The eighth aspect of the present invention resides in the image forming apparatus having any one of the above first through seventh aspects, wherein once the operational environment has been determined based on the information, the controller cannot change the determined operational environment thereafter.

The ninth aspect of the present invention resides in the image forming apparatus having any one of the above first through seventh aspects, wherein once the operational environment has been determined based on the information, the controller is able to vary the determined operational environment thereafter within the predetermined range.

The tenth aspect of the present invention resides in the image forming apparatus having any one of the above first through ninth aspects, wherein if a container which needs a change of operational environment is mounted in the course of usage, the controller informs an operator of a fact.

In the present invention, based on the information obtained from the usage item container mounted to the machine base, the operational environment under which the apparatus will be installed at a local site is determined. That is, each container has different characteristics corresponding to the installed site (destination) where it is used with the image forming apparatus and has the information as to the characteristics in the management portion. When this usage item container is mounted to the image forming apparatus, the controller of the image forming apparatus, based on the information of this usage item container, adjusts the necessary parts of the image forming apparatus to the operating conditions matching the environment of the installed site (destination).

In this case, the container is a developer supply cartridge or a fixing unit, for example. The consumable item stored in the developer supply cartridge is a developer. The constituents contained in the fixing unit are fixing rollers and a heater. The information as to the constituent and consumable item includes the life information (the life time matching the country or site where the machine is installed: the used amount of developer or replacement timing of the fixing unit, etc.), the characteristics information (the characteristics suited for the country or site where the machine is installed: the developer material, fixing conditions, etc.). The operational environment designated by the controller includes the destination of the apparatus, the used language, the power supply voltage and warning management and display management of the timings and types of maintenance (types of user maintenance, types of serviceperson maintenance).

In this way, necessary conditions in accordance with the environment (destination country, installed site, etc.) under which the machine is installed are automatically set up, so that the various on-site setting of conditions needed up to now becomes no longer necessary. The setting of the timings and types of maintenance based on the life times and characteristics of items used resulting from difference in maintenance type becomes unnecessary too. Since the machine base can be used in common, this configuration is advantageous in cost throughout the stages of commodity production, stock and shipment, because it is no longer necessary to line up many kinds of machine bases, as have been needed conventionally.

BEST MODE FOR CARRYING OUT THE INVENTION

The embodiment of the present invention will be described herein below.

Figure 1:
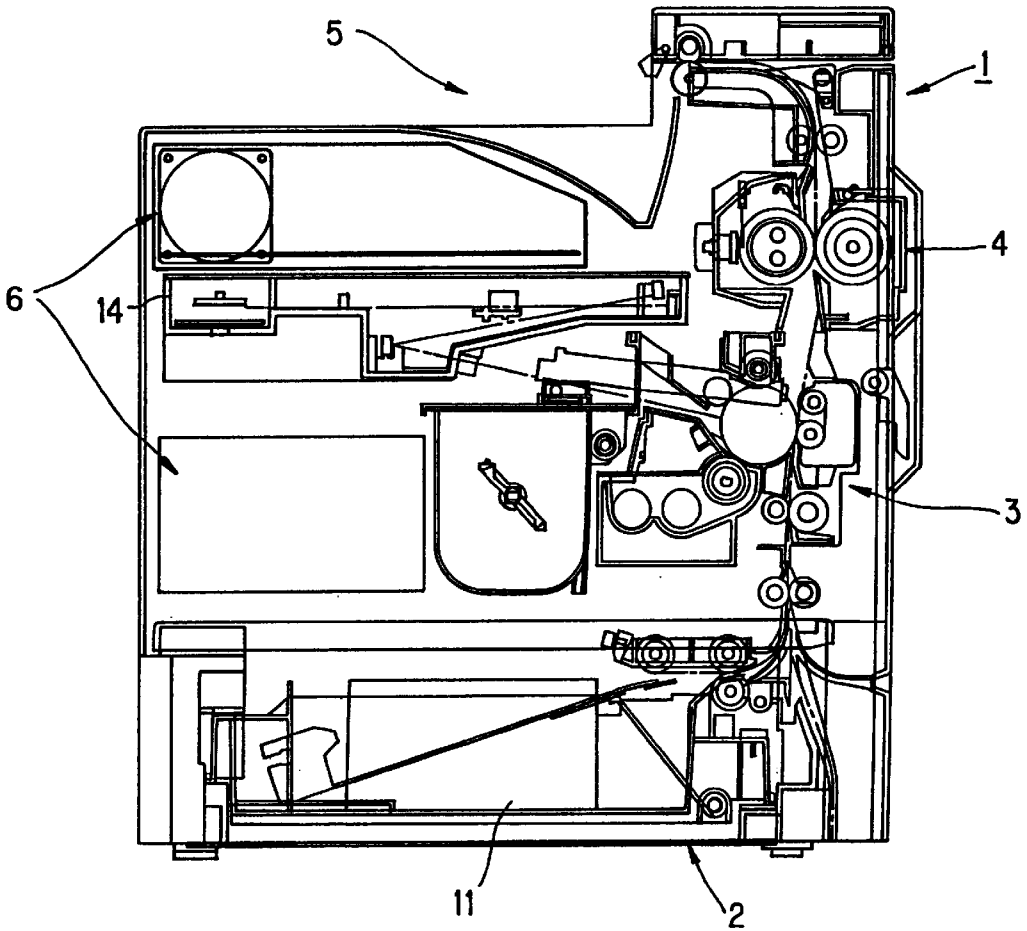
FIG. 1 is a sectional structural view showing one embodiment of an image forming apparatus in accordance with the present invention.
Figure 2:
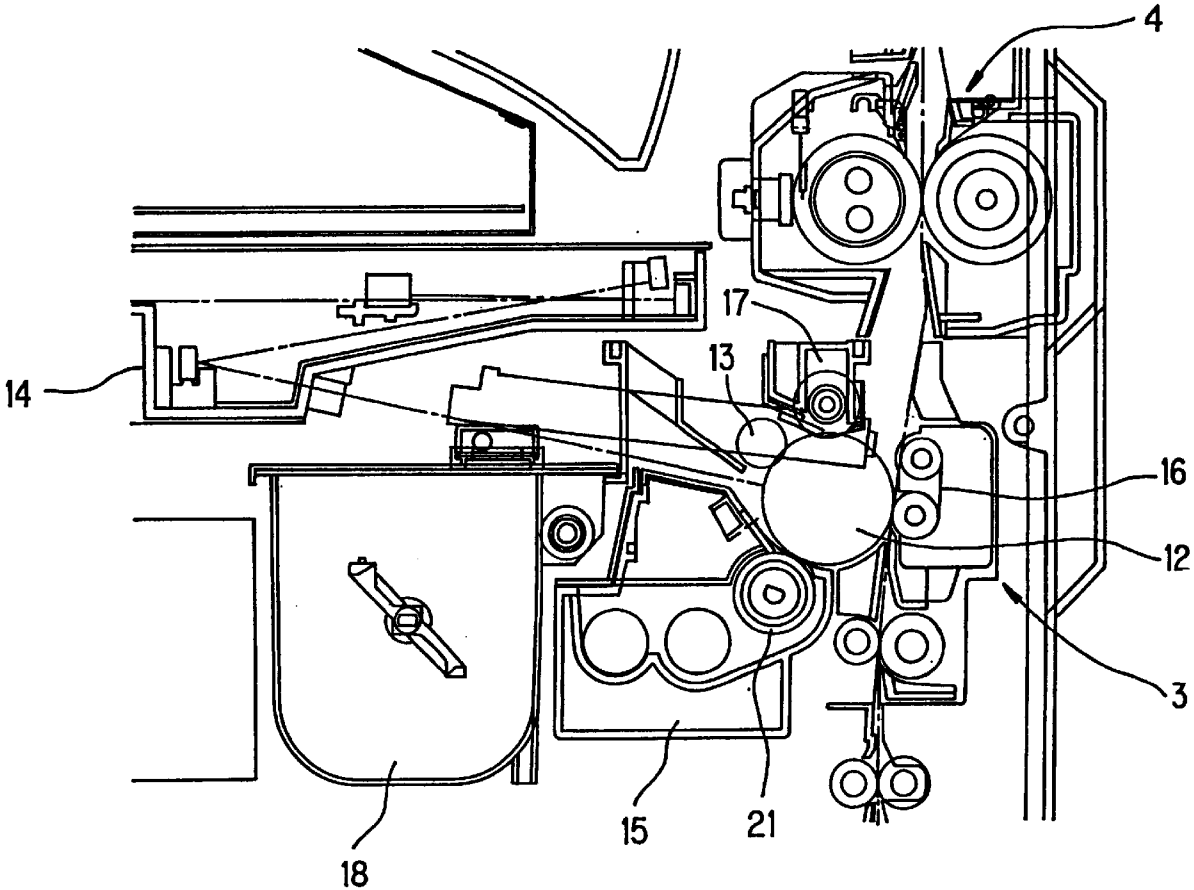
FIG. 2 is a partially enlarged sectional structural view showing the same image forming apparatus.

FIG. 1 is a sectional structural view showing one embodiment of an image forming apparatus in accordance with of the present invention. FIG. 2 is a partially enlarged sectional structural view showing this image forming apparatus. This image forming apparatus is a laser printer, to which an image processor such as a personal computer is connected so that image data from this externally connected device is recorded to be output. As shown in FIG. 1, this machine base 1 includes a recording media feeder 2, electrophotographic processor assembly 3, fixing unit 4, recording media output portion 5, power and control unit 6.

Recording media feeder 2 for storing recording media is arranged under and within machine base 1 so that it is not projected from the machine base 1. This recording media feeder 2 has a recording media storage tray 11. For setting recording media, the feeder is drawn to the front of image forming machine base 1, so that recording media is supplied or replaced with another. The recording media, separated and fed, sheet by sheet, from this recording media feeder 2 are successively fed to electrophotographic processor assembly 3, in synchronization.

Electrophotographic processor assembly 3 is arranged in the approximate center of machine base 1. As shown in FIG. 2, electrophotographic processor assembly 3 has a photosensitive drum 12, and further includes a charger roller 13 for uniformly charging the photosensitive drum 12 surface, an optical scanning unit 14 for scanning an optical image on the uniformly electrified photosensitive drum 12 to write an electrostatic latent image thereon, a developing unit 15 for developing the static latent image written by optical scanning unit 14 with the developer, a transfer unit 16 for transferring the image recorded and reproduced on photosensitive drum 12 onto the recording medium and a cleaning unit 17 for removing the leftover developer on photosensitive drum 12 so as to allow a next cycle of image recording on photosensitive drum 12, all being arranged around the photosensitive drum 12, in the order mentioned.

The recording medium fed from recording media feeder 2 is sequentially fed into the nip between photosensitive drum 12 and transfer unit 16 in electrophotographic processor assembly 3, in synchronization so that the recorded and reproduced image on photosensitive drum 12 is transferred to the medium.

A fixing unit 4 is arranged above electrophotographic processor assembly 3 so as to successively receive the recording media with images transferred thereon and fuse and fix the developer images transferred on the recording media and discharge them out of the machine. The recording medium with an image recorded thereon is received by recording media output portion 5 on the top of the image forming apparatus.

Arranged in the space above and below optical scanning unit 14 is a power and control unit 6. That is, power and control unit 6 includes a process control unit (PCU) board for controlling the electrophotographic process, an interface board for receiving image data from external devices, an image control unit (ICU) board for subjecting the image data received through the interface board to predetermined image processes and recording the image by scanning of optical scanning unit 14, a power unit for supplying electric power to these boards and units, and the like.

In the description herein, a configuration of a single recording media feeder 2 for storing recording media is described, but more than one recording media feeder 2 may be incorporated in machine base 1.

Next, the overall operation of the image forming apparatus will be described.

Photosensitive drum 12 is uniformly charged by charger unit 13 and is written with an optical image by optical scanning unit 14. In order to make the electrostatic latent image thus formed on photosensitive drum 12 visual, the developer is stored in developing unit 15 provided in electrophotographic processor assembly 3. This developer is supplied from a developer roller 21 to which a bias voltage is applied, to the static latent image. In this way, the static latent image on photosensitive drum 12 is developed with the developer to be reproduced as a visual image.

Since the developer in developing unit 15 is consumed as every static latent image is developed, a predetermined amount of developer is supplied to developing unit 15 from a developer supply unit 18 located on the left side of developing unit 15.

Further, the developer image reproduced on photosensitive drum 12 as a visual image is transferred to the recording medium by transfer unit 16, but a small amount of developer is left over on photosensitive drum 12.

This developer is removed and collected by cleaning unit 17 so that photosensitive drum 12 is set ready for a next cycle of image recording. The developer removed and collected hereby is returned to the aforementioned developer supply unit 18 by way of the collecting path. This developer is prone to be polluted with foreign substances such as paper particles etc., generated in the transfer step, so if it is directly returned into developer supply unit 18, this will contaminate with fresh developer, affecting the quality of the image reproduced in the development step. To deal with this, a filter removing foreign substances involved in the developer is provided in the collection path that allows the developer to be collected to developer supply unit 18. This filter is integrally formed with developer supply unit 18 so that the filter can be replaced when the developer supply unit 18 is replaced with a fresh unit.

Figure 3:
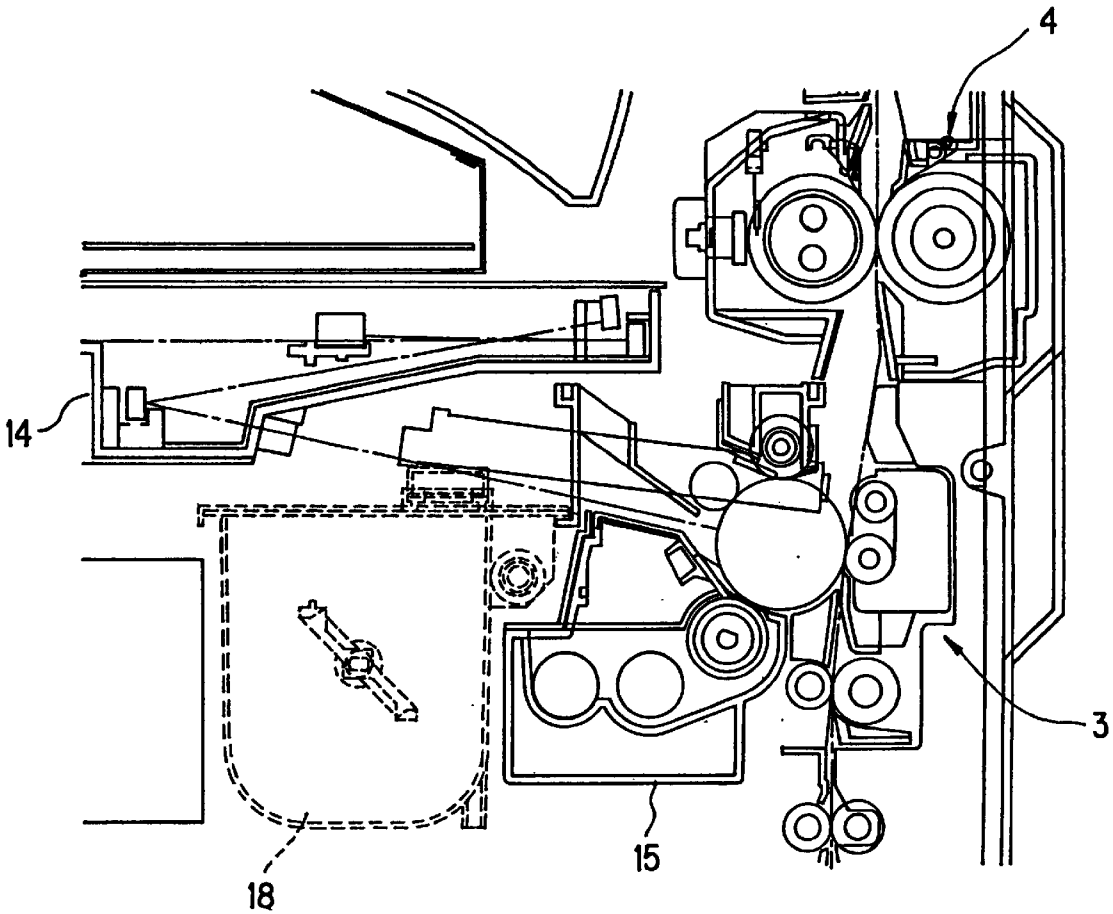
FIG. 3 is a sectional structural view showing an image forming apparatus with its developer cartridge removed.
Figure 4:
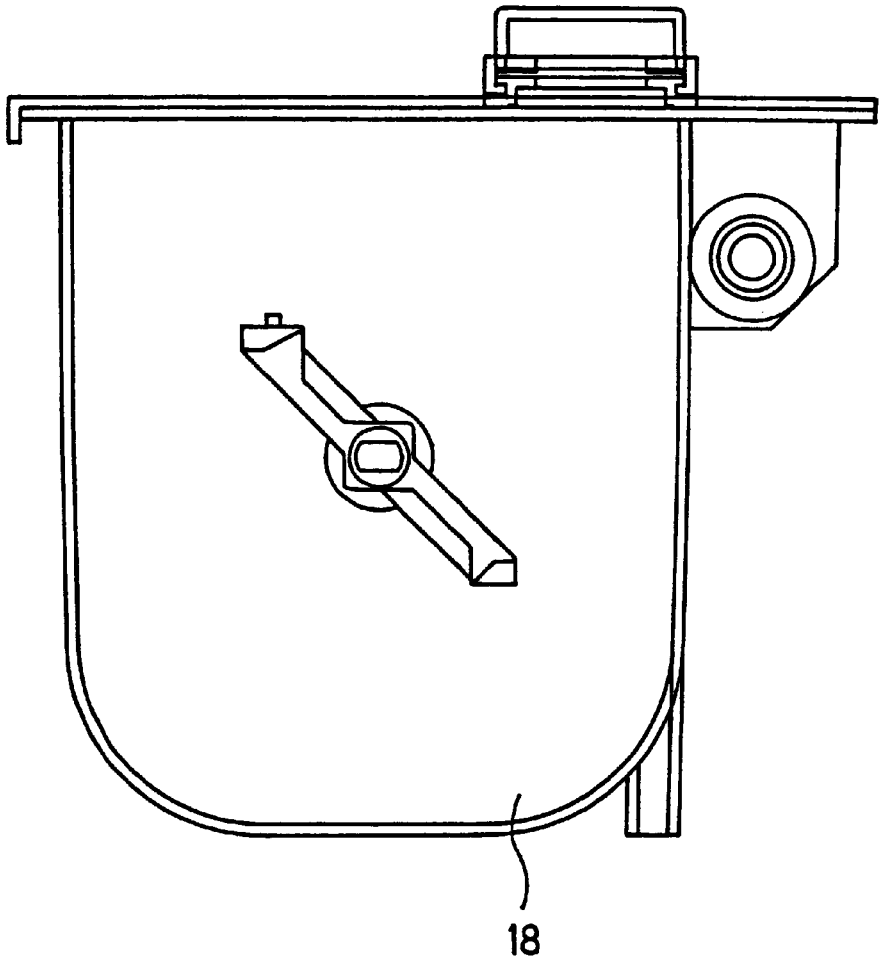
FIG. 4 is a sectional structural view showing a developer cartridge.

FIG. 3 shows the image forming apparatus with developer supply unit 18 removed from electrophotographic processor assembly 3. FIG. 4 is a sectional view showing developer supply unit 18. The developer supply unit is used as the means for storing the developer to be used for image forming and this is detachably mounted to machine base 1. Therefore, when developer supply unit 18 shown in FIG. 4 is mounted to the predetermined position (shown by the broken line) of electrophotographic processor assembly 3 in FIG. 3, the unit is set as shown in FIG. 2 so that the developer can be supplied from developer supply unit 18 to developing unit 15.

Figure 5:
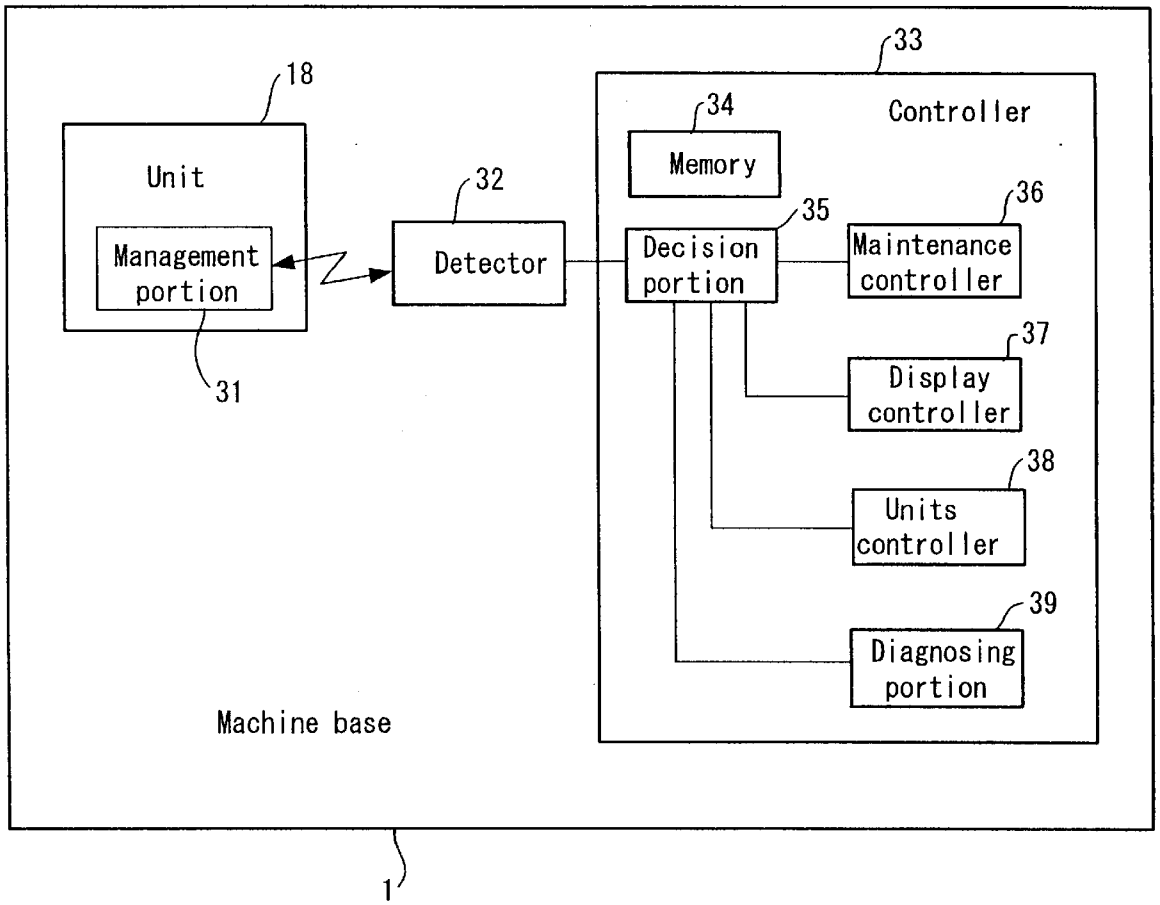
FIG. 5 is a block diagram showing a controller and a unit to be mounted to the machine base.
Figure 6:
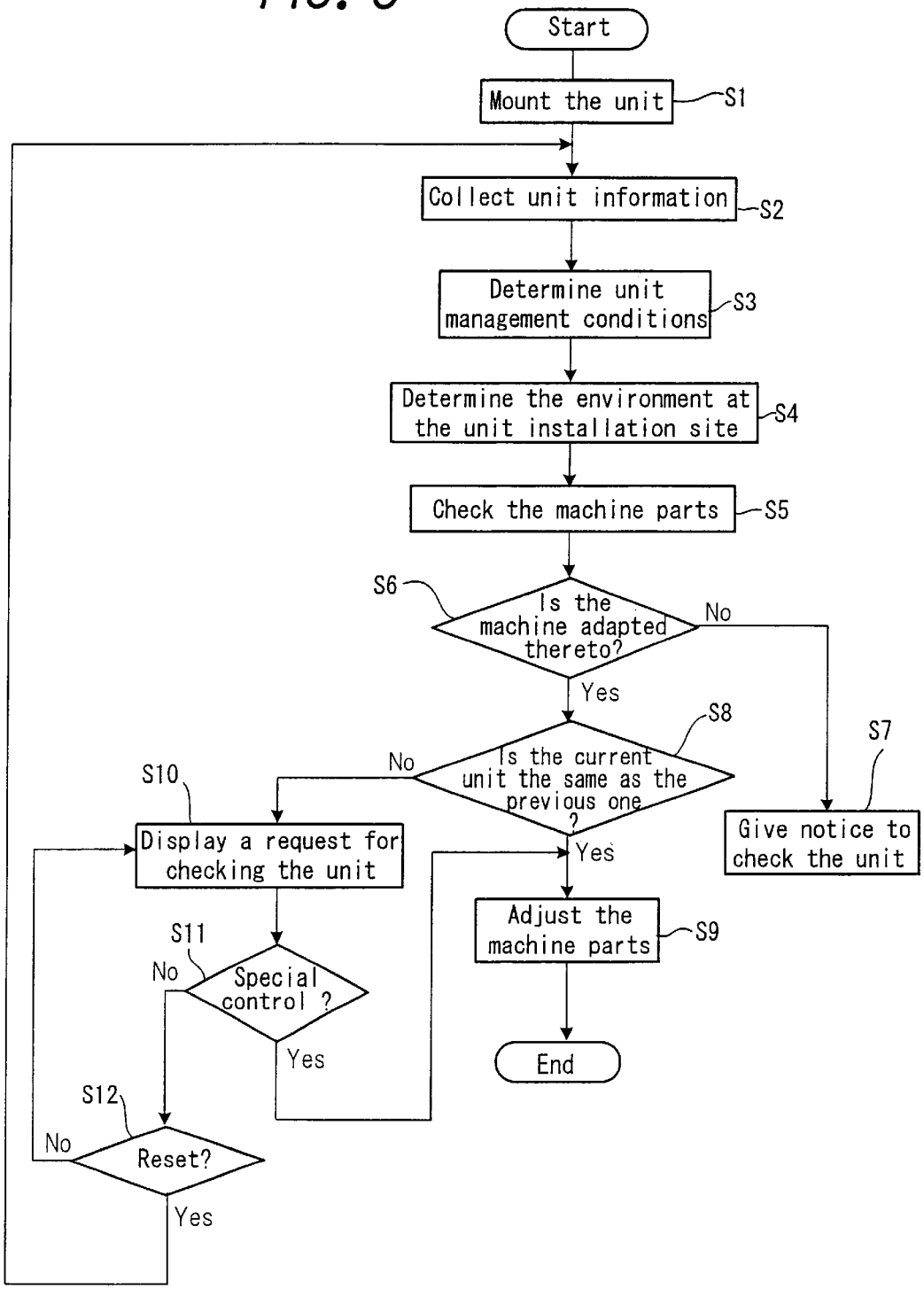
FIG. 6 is a flowchart showing the control sequence from collection of information as to a developer cartridge to setting of the environment for the image forming apparatus.

FIG. 5 is a block diagram showing a controller and the unit to be mounted to the machine base. FIG. 6 is a flowchart showing the control sequence from collection of information as to the developer cartridge to setting of the environment for the image forming apparatus.

As shown in FIG. 5, unit (developer supply unit) 18 to be mounted to the predetermined position of machine base 1 has a management portion 31 managing an information source (magnetic memory, semiconductor memory, optical recognition memory, bar codes, seals, characters, etc.) concerning the amount of developer stored therein and the characteristics of the developer.

Power and control unit 6 of machine base 1 has a detector 32 and a controller 33. Controller 33 is comprised of a memory 34, decision portion 35, maintenance controller 36, display controller 37, units controller 38 and diagnosing portion 39.

As detector 32, a suitable information reader is selected based on the type of the information source (magnetic memory, semiconductor memory, optical recognition memory, bar codes, seals, characters, etc.).

Next, the operation of each part will be described with reference to FIGS. 5 and 6.

When unit (developer supply unit) 18 is mounted to the predetermined position of machine base 1 (Step S1), detector 32 disposed on the machine side extracts the information managed by management portion 31 of unit 18 (Step S2). Based on the management information, decision portion 35 of controller 33 determines the characteristics of developer supply unit (cartridge) 18 so as to decide the operating conditions of each unit portion (Step S3).

At the same time, the operational environment under which the machine will be installed is decided on based on the determined result (Step S4). Once the operating conditions of all the parts have been determined in the above way, diagnosing portion 39 checks all the unit portions other than unit 18 (Step S5) and judges whether the machine is able to operate under the operational environment under which it will be installed (Step S6). For example, when the machine was determined to be destined for the U.S. market, it is checked beforehand if the power unit and fixing unit are adapted to 200 volts.

If it is not adapted thereto, a warning to check whether a correct unit 18 is mounted is given to the operation. If it is adapted thereto, diagnosing portion 39 recalls the information of the previous operational environment (the environment set up based on the previously mounted unit 18) from memory 34 and checks whether the current environment is the same as the previous one.

If the current environment is the same as the previous one (or if this is the first setting), according to the instruction from decision portion 35, the maintenance environment (notice management and display management as to the timings, types, etc. of maintenance) of machine base 1 is automatically set at maintenance controller 36, the display language (Japanese display, English display or the like) is automatically set at display controller 37, the operating and control conditions of the individual units (power supply voltage, fixing temperature control, etc. are automatically set at units controller 38 (Step S9).

Though the above description was made referring to a configuration in which the information of the developer supply unit (cartridge) 18 storing the developer is used to set the operational environment under which the machine is installed, other constituting parts used for the image forming process, e.g., fixing unit 4, may be used. Since the power supply voltages differ depending on the destinations, the specifications of the heating device (heater) for fixing in fixing unit 4 can be different. Therefore, the operational environment under which the machine is installed may be determined and automatically set similarly based on the information as to fixing unit 4.

Description will be made of the problem when the determined result at Step S8 differs from the previous one.

Though it can not normally happen, if a wrong unit is miss-mounted and diagnosing portion 39 determines that the operational environment has changed from the previous one, a request for the operator to check is displayed (Step S10). This step is to prevent the maintenance cycle from being disordered, the operation from becoming unstable or the machine from breaking down in the worst case, due to setting of a different unit from the previous one.

However, there are possibilities that the maintenance regime may change because of an office move. In such a case, it is possible to alter the setup variables within the specified ranges by special control by a special operator such as a serviceperson (Step S11).

When the setup variables cannot be adjusted so as to fall within the specified ranges, another, conformable unit 18, is set instead (Step S12) and the operation returns to Step S2. If no unit is reset, the check request display state will continue (Step S10).

Detector 32, in addition to reading of the information from management portion 31, detects and monitors the conditions of consumable items (the used amount, timing of replacement of developer and the like) in unit 18. The detected data is sent to controller 33. Decision portion 35 of controller 33 resets the maintenance environment (notice management and display management as to the timings, types, etc. of maintenance) at maintenance controller 36, for example.

As has been described, according to the first aspect of the present invention, when the apparatus is installed, mounting the container including a constituent or consumable item suitable for the environment of the installed location enables the controller to automatically set necessary conditions without the necessity of fine adjustment of setting by serviceperson as needed conventionally, so that the apparatus is able to be ready to operate under the environment of the installed location. This improves the efficiency of setup work by the serviceperson, reducing the time from the carrying-in to the completion of installation. Further, this configuration is effective in the aspect of managing trade inventories within the market and makes it possible to reduce the cost and hence lower the market price.

This configuration makes unnecessary the setting of the maintenance system (timings, types or the like) depending on the life and characteristics of the constituent or consumable item, derived from the difference in user maintenance specifications and serviceperson maintenance specifications. Further, since the machine base can be commonly used, this configuration is advantageous in cost throughout the stages of commodity production, stock and shipment, because it is no longer necessary to line up many kinds of machine bases, as have been needed conventionally.

In accordance with the second aspect of the present invention, since the detector monitors the condition of the constituent and consumable item mounted to the machine base, it is possible to manage the life and other factors based on the information as to the constituent or consumable item, thus achieving effective maintenance.

In accordance with the third aspect of the present invention, since it is checked whether the apparatus is adapted to operate under the operational environment at the installed site, determined based on the information obtained from the constituent or consumable item attached to the machine base, it is possible to prevent occurrence of troubles in maintenance management due to difference of the constituent or consumable item in life and occurrence of the image quality being affected due to difference of the consumable item in characteristics, resulting from mis-attachment of a wrong constituent or consumable item.

In accordance with the fourth aspect of the present invention, since the management portion manages the information as to fixing conditions, it is possible to automatically set up the fixing conditions of the fixing unit, which need to be adjusted depending on the power supply voltage at the local site. Further, according to fifth to seventh aspects of the present invention, since the operational environment determined by the controller is the destination at which the apparatus is installed, the language to be displayed on the display, and the power supply voltage at the local site, it is possible to automatically set necessary conditions relating to these factors.

In accordance with the eighth aspect of the present invention, once the operational environment of the machine base has been determined, the determined operational environment will not be able to be changed thereafter. Therefore, once the apparatus is installed at a local site, it is possible to prevent occurrence of troubles in maintenance management due to difference of the constituent or consumable item in life and occurrence of the image quality being affected due to difference of the consumable item in characteristics, resulting from mis-attachment of a wrong constituent or consumable item.

In accordance with the ninth aspect of the present invention, once the operational environment of the machine base has been determined, the controller is able to vary the determined operational environment thereafter within the predetermined range. Therefore, once the apparatus is installed at a local site, it is possible to prevent occurrence of troubles in maintenance management due to difference of the constituent or consumable item in life and occurrence of the image quality being affected due to difference of the consumable item in characteristics, resulting from mis-attachment of a wrong constituent or consumable item.

There are possibilities that the maintenance environment may change because of an office move, purchase of a second-hand machine or the like. To deal with such a case, this configuration is adapted to allow the operational environment of the apparatus to be changed within the specified range.

In accordance with the tenth aspect of the present invention, if a container which needs a change of the operational environment is mounted to the machine base in the course of usage, the operator is informed of this fact. Therefore, once the apparatus is installed at a local site, it is possible to prevent occurrence of troubles in maintenance management due to difference of the constituent or consumable item in life and occurrence of the image quality being affected due to difference of the consumable item in characteristics, resulting from mis-attachment of a wrong constituent or consumable item.

There are possibilities that the maintenance environment may change because of an office move, purchase of a second hand machine or the like. Therefore, this configuration is adapted to allow the operational environment of the apparatus to be changed within the specified range, only after giving a warning to the user and their recognition of it.

Industrial Applicability

The image forming apparatus according to the present invention is a type of image forming apparatus which is enabled to form images by mounting part of the constituents, for example, attachment of a process unit, developer cartridge, and the like, for the process of recording images and is suitable to be applied to the configuration in which the operational process, setup conditions and the like are varied in accordance with the operational environment at the installed site of the apparatus.

What is claimed is:

1. An image forming apparatus for forming images on recording media, comprising:

a container of a constituent or consumable item to be used for image forming, including the constituent or consumable item and being removably attached to a machine base; and a controller for controlling the operations of various parts in the apparatus including operation of the container, wherein the container has a management portion having information as to the constituent or consumable item contained therein, and wherein the controller determines an operational environment under which the apparatus will be installed, based on the information, and sets operating conditions of the various parts of the apparatus.

2. The image forming apparatus according to claim 1, further comprising:

a detector for detecting a condition of the constituent or consumable item wherein the controller, based on the information, monitors the condition of the constituent or consumable item by the detector.

3. The image forming apparatus according to claim 1, wherein the controller checks if each part in the apparatus is capable of operating within the operational environment at a determined installed location.

4. The image forming apparatus according to claim 1 or 3, wherein the constituent or consumable item is a fixing unit, and the information managed by the management portion is information as to fixing conditions of the fixing unit.

5. The image forming apparatus according to claim 1 or 3, wherein the determined operational environment of the apparatus is a destination where the apparatus will be installed.

6. The image forming apparatus according to claim 1 or 3, wherein the determined operational environment of the apparatus is a language to be displayed on a display portion of the apparatus.

7. The image forming apparatus according to claim 1 or 3, wherein the determined operational environment of the apparatus is power supply voltage to be supplied to the apparatus.

8. The image forming apparatus according to claim 1 or 3, wherein once the operational environment has been determined based on the information, the controller cannot change the determined operational environment thereafter.

9. The image forming apparatus according to claim 1 or 3, wherein once the operational environment has been determined based on the information, the controller is able to vary the determined operational environment thereafter within the predetermined range.

10. The image forming apparatus according to claim 1 or 3, wherein if a container which needs a change of operational environment is mounted in the course of usage, the controller informs an operator of a fact.

11. A container apparatus for an image forming apparatus having a controller for determining an operational environment under which the image forming apparatus will be installed, based on information, for setting operating conditions of various parts of the image forming apparatus, and for controlling the operations of the various parts in the image forming apparatus comprising:

a constituent or consumable item in the container for use in an image forming;

a management portion having information as to the constituent or consumable item; and wherein when the container is attached to an image forming apparatus, the information is read out by the image forming apparatus.

* * * * *